US005836056A

United States Patent [19]

Porchia et al.

[11] Patent Number: 5,836,056

[45] Date of Patent: Nov. 17, 1998

[54] RECLOSABLE FASTENER ASSEMBLY

[75] Inventors: Jose Porchia, Midland; Brian C. Dais, Sanford; Kenneth A. Toney; Judi R. Welsh, both of Midland, all of Mich.

[73] Assignee: S. C. Johnson Home Storage Inc., Racine, Wis.

[21] Appl. No.: 846,082

[22] Filed: Apr. 25, 1997

Related U.S. Application Data

[63] Continuation-in-part of Ser. No. 711,643, Sep. 10, 1996.

[51] Int. Cl.[6] ..... A44B 19/00

[52] U.S. Cl. ..... 24/400; 24/399; 24/587

[58] Field of Search ..... 24/400, 399, 587, 24/576; 383/63

[56] References Cited

U.S. PATENT DOCUMENTS

| | | | |
|---|---|---|---|
| 3,122,807 | 3/1964 | Ausnit . | |
| 3,173,184 | 3/1965 | Ausnit . | |
| 3,426,396 | 2/1969 | LaGjerra . | |
| 4,262,395 | 4/1981 | Kosky . | |
| 5,007,143 | 4/1991 | Herrington . | |
| 5,020,194 | 6/1991 | Herrington et al. . | |
| 5,067,208 | 11/1991 | Herrington, Jr. et al. | 24/400 |
| 5,070,583 | 12/1991 | Herrington | 24/400 |
| 5,301,395 | 4/1994 | Richardson et al. . | |
| 5,442,837 | 8/1995 | Morgan | 24/587 |
| 5,442,838 | 8/1995 | Richardson et al. . | |

*Primary Examiner*—Victor N. Sakran

[57] ABSTRACT

A reclosable fastener assembly comprising a first fastener strip, a second fastener strip and a slider. The first fastener strip has an inner surface and an outer surface, including at least an uppermost closure element and a bottommost closure element positioned along the length of the inner surface. The second fastener strip has an inner surface and an outer surface, including at least an uppermost closure element and a bottommost closure element positioned along the length of the inner surface. The closure elements along the second fastener strip are adapted to engage with the closure elements along the first fastener strip, thereby interlocking the second fastener strip with the first fastener strip. The slider has a top and side walls depending from opposite sides of the top for receiving the fastener strips therebetween, the side walls extending downward from the top to a point below the uppermost closure elements, so that at least a portion of the fastener strips are held between the side walls. The side walls also extend from a separating end of the slider to a pinching end. Pinching means are positioned proximate to the pinching end. The slider also includes a separating leg depending from the top between the first and second side walls at the separating end of the slider. The separating leg penetrates at least one of the uppermost closure elements of the first or second fastener strips, but not the bottommost closure elements.

12 Claims, 4 Drawing Sheets

RECLOSABLE FASTENER ASSEMBLY

CROSS REFERENCE TO RELATED APPLICATION

This is a Continuation-In-part of application Ser. No. 08/711,643 filed Sep. 10, 1996.

BACKGROUND OF THE INVENTION

Reclosable fastener assemblies are useful for sealing thermoplastic bags. Such fastener assemblies often include a plastic zipper and a slider. Typically, the plastic zippers include a pair of interlockable fastener elements which form a closure. As the slider moves across the fastener strips, the fastener is opened or closed.

The fastener elements in plastic zippers can take on various configurations. For example, U.S. Pat. No. 5,140,727 describes interlocking rib and groove elements, whereas U.S. Pat. No. 5,007,143 describes rolling action closure elements, and U.S. Pat. No. 4,747,702 describes closure elements that are U-shaped with interlocking hooks.

The sliders for opening or closing the reclosable fasteners are generally shaped so that the slider straddles the profiles. The sliders often include a separator that is inserted between the fastener strips through the closure elements in order to open the fastener. Such a slider is described in U.S. Pat. No. 5,067,208. In other types of sliders, the separator does not penetrate the closure elements, but rather, slides above the closure elements on a specially adapted track located above the closure elements, as described in U.S. Pat. No. 5,007,143. The separators have various shapes. For example, U.S. Pat. No. 3,173,184 describes a V-shaped separator, while U.S. Pat. No. 5,067,208 describes a tapered separator with a circular end.

A disadvantage of the known fastener assemblies is that thermoplastic bags incorporating the fastener assemblies often leak. It would be an advance in the art of reclosable fastener assemblies to minimize leakage through the closure with a simplified slider design.

SUMMARY OF THE INVENTION

The present invention addresses the above problems. In one aspect, the present invention is a reclosable fastener assembly comprising a first fastener strip, a second fastener strip and a slider. The first fastener strip has an inner surface and an outer surface, including at least an uppermost closure element and a bottommost closure element positioned along the length of the inner surface. The second fastener strip has an inner surface and an outer surface, including at least an uppermost closure element and a bottommost closure element positioned along the length of the inner surface. The closure elements along the second fastener strip are adapted to engage with the closure elements along the first fastener strip, thereby interlocking the second fastener strip with the first fastener strip.

The slider is designed for moving between a closed position and an open position along the fastening strips in straddling relation. The slider has a top and side walls depending from opposite sides of the top for receiving the fastener strips therebetween, the side walls extending downward from the top to a point below the uppermost closure elements, so that at least a portion of the fastener strips are held between the side walls. The side walls also extend from a separating end of the slider to a pinching end. Pinching means are positioned proximate to the pinching end, the pinching means being adapted to press the first and second fastener strips into an interlocked relationship as the slider is moved toward the closed position.

The slider also includes a separating leg depending from the top between the first and second side walls at the separating end of the slider. The separating leg penetrates at least one of the uppermost closure elements of the first or second fastener strips, but not the bottommost closure elements.

DESCRIPTION OF THE PREFERRED EMBODIMENTS

Figure 1:
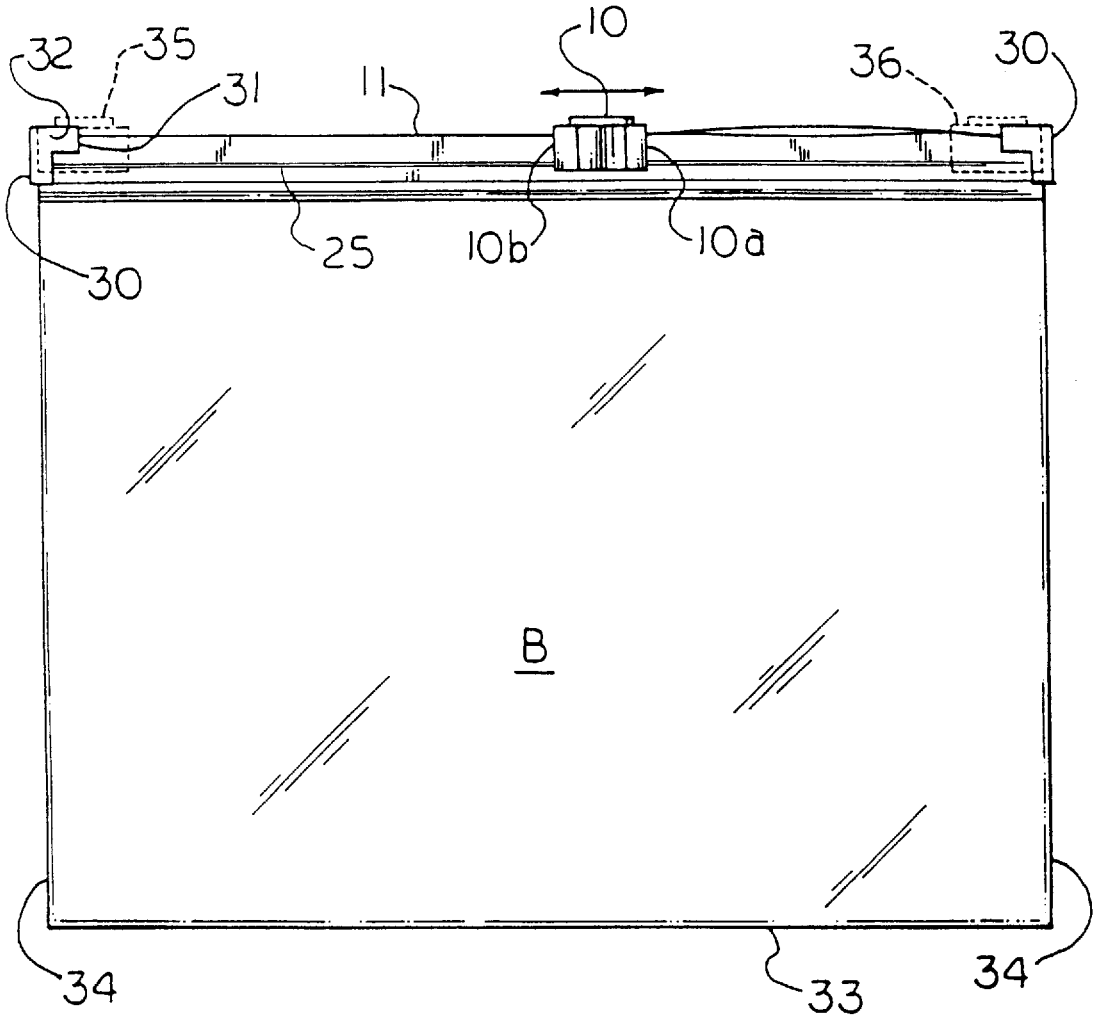
FIG. 1 is a plan view of a thermoplastic bag having a fastener assembly.

Referring now to FIG. 1, therein is shown a reclosable thermoplastic bag B having a profiled plastic reclosable fastener 11 and a slider 10, embodying the present invention. Bag B also has a sealed bottom 33 and two opposing sealed edges 34. Bag B may be made from any suitable thermoplastic film such as, for example, low density polyethylene, linear low density polyethylene, substantially linear copolymers of ethylene and a C3–C8 α-olefin, polypropylene, polyvinylidene chloride, mixtures of two or more of these polymers, or mixtures of one or more of these polymers with another thermoplastic polymer.

Figure 2:
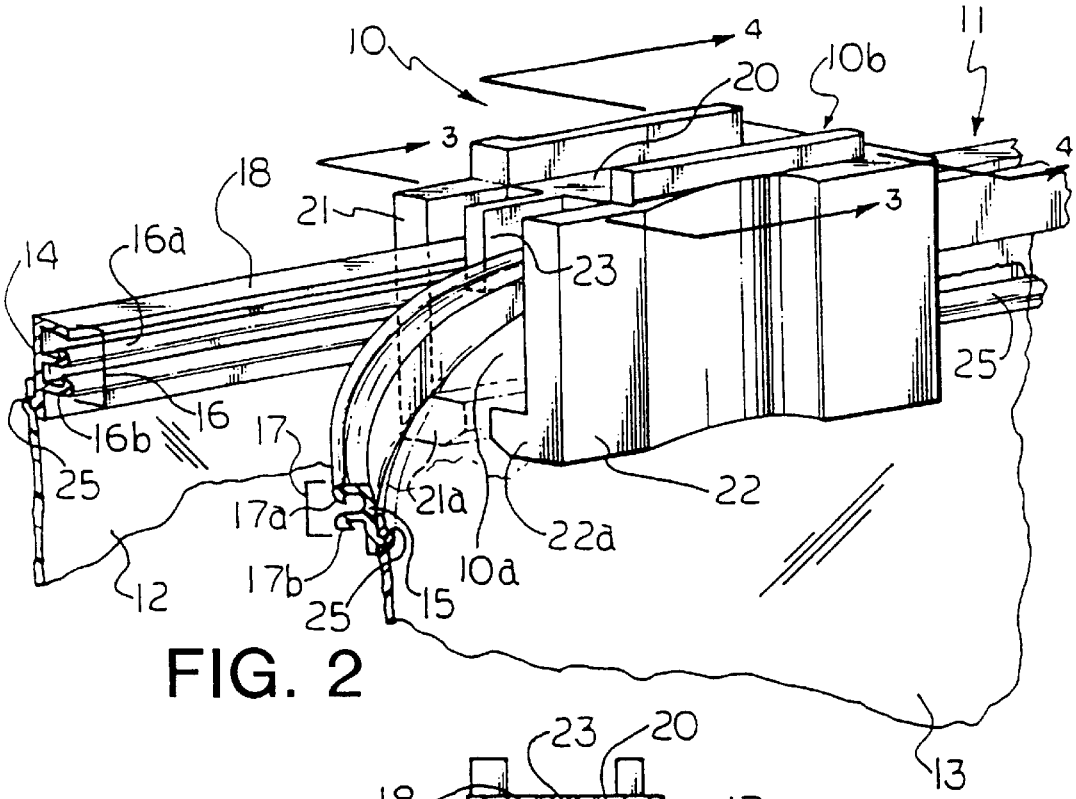
FIG. 2 is a perspective view of a reclosable thermoplastic bag with a fastener assembly.
Figure 3:
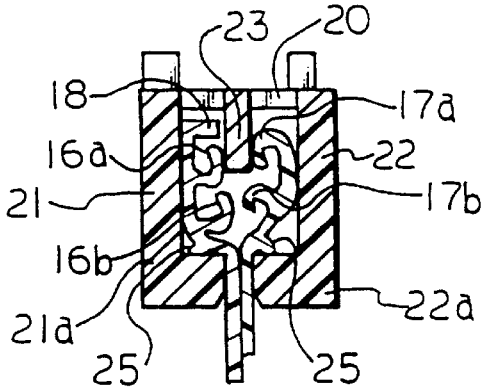
FIG. 3 is a cross sectional view of an open fastener assembly of the instant invention taken along line 3—3 of FIG. 2.

Referring now to FIG. 2, the bag B comprises a pair of flexible plastic sheets 12 and 13. The sheet 12 has a top edge having a first fastener strip 14 attached thereto, with an inner surface on the inside of the bag and an outer surface on the outside of the bag. The sheet 13 has a top edge having a second fastener strip 15 attached thereto, with an inner surface on the inside of the bag and an outer surface on the outside of the bag. The strips 14 and 15 may be extruded separately and attached to the respective sides of the bag mouth or they may be extruded integrally with the sides of the bag mouth.

as shown in FIGS. 2–5, the first fastener strip 14 has at least an uppermost closure element 16*a* and a bottommost closure element 16*b* which project laterally from the inner surface of strip 14. Likewise, the second fastener strip 15 has at least an uppermost closure element 17*a* and a bottommost closure element 17*b* which project laterally from the inner surface of strip 15. When the bag is closed, closure elements 16*a* and 16*b* interlock with corresponding closure elements 17*a* and 17*b*. As shown in FIGS. 2–5, closure elements 16*a*, 16*b*, 17*a* and 17*b* have hooks on the ends of the closure elements, so that the fastener strips 14 and 15 remain interlocked when the bag is closed, thereby forming a seal.

Under normal use, the seal advantageously forms a barrier to liquids. Fastener strips 14 and 15 can each have more than two closure elements, so that any number of closure elements can be disposed between the uppermost and bottommost closure elements. The closure elements can be any shape, such as a rib and groove shape as described in U.S. Pat. No. 5,140,727, or an angled hook shape, as described in U.S. Pat. No. 4,747,702.

Figure 4:
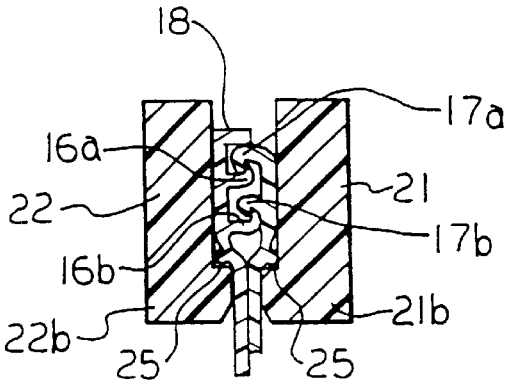
FIG. 4 is a cross sectional view of a closed fastener assembly of the instant invention taken along line 4—4 of FIG. 2.

When the bag B is open, fastener strips 14 and 15 are separated from each other. As shown in FIG. 4, closure elements 16*a*, 17*a*, 16*b*, and 17*b* have complimentary cross-sectional shapes such that they are interlocked by pressing the fastener strips 14 and 15 together. The pressing action is accomplished by pinching means positioned proximate to pinching end 10*b* of the slider 10, described hereinbelow.

Referring again to FIG. 1, the slider 10 moves between a closed position 35 and an open position 36. Thus, when the slider 10 reaches the closed position 35 at one end of the fastening strips, the bag is closed, and the closure elements are interlocked throughout substantially their entire length. When the slider reaches the open position 36 at the opposite end of the fastening strips, the bag is open and the closure elements are disengaged throughout most of their length. It should be understood that it is sufficient for the bottommost closure elements 16*b* and 17*b* to be interlocked with each other throughout substantially their entire length, in order for the bag to be closed. Preferably, the uppermost closure elements 16*a* and 17*a* are also interlocked with each other.

Referring now to FIG. 2, the straddling slider 10 comprises an inverted U-shaped member having a top 20 for moving along the top edges of the strips 14 and 15. The slider 10 has side walls 21 and 22 depending from the top 20. Side walls 21 and 22 extend downward along the outer surface of the fastener strips 14 and 15, to a point below the uppermost closure elements 16*a* and 17*a*, so that at least a portion of the fastener strips 14 and 15 are held between the side walls 21 and 22. Thus, side walls 21 and 22 cooperate with the strips 14 and 15 so that, as the slider moves between the open and closed position, strips 14 and 15 are received between the side walls 21 and 22.

Figure 6:
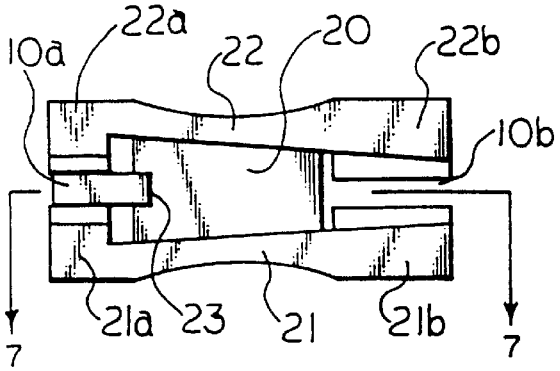
FIG. 6 is a bottom plan view of the slider in FIG. 2.
Figure 7:
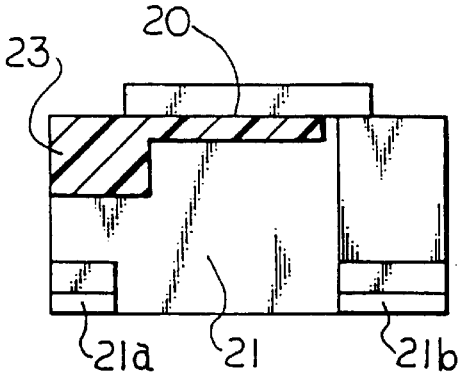
FIG. 7 is a cross sectional view of a slider taken along line 7—7 of FIG. 6.

As shown in FIG. 6, side walls 21 and 22 extend from a separating end 10*a* of the slider to a pinching end 10*b* of the slider. Pinching means are positioned proximate to the pinching end 10*b*. The effect of the pinching means is to pinch, or squeeze the fastening strips together, thereby forcing the closure elements 16*a* 16*b* 17*a* and 17*b* into an interlocked relationship.

Figure 8:
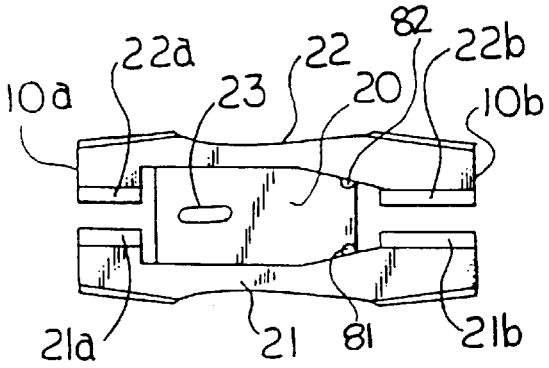
FIGS. 8–8A are bottom and cross sectional views, respectively, of an alternate embodiment of a slider.
Figure 8A:
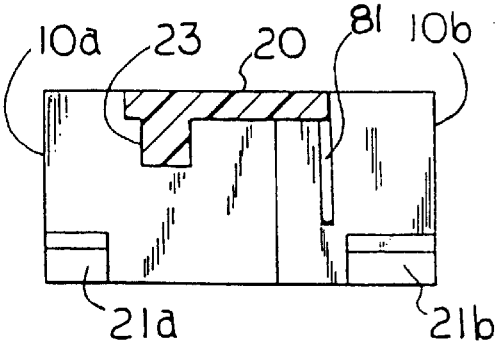

Examples of pinching means are shown in FIGS. 8–8A. Pinching means can include vertical ribs 81 and 82, which are spaced close together relative to the sidewalls 21 and 22. The close spacing of the ribs forces the fastener strips together, thereby interlocking the closure elements. Pinching means can also include closely spaced walls proximate to the pinching end 10*b*. In this manner, the sidewalls 21 and 22 are tapered so that the space between the sidewalls at the pinching end 10*b* is narrower than the space between the sidewalls at the separating end 10*a*. The close spacing of the walls forces the fastener strips together. A combination of ribs 81 and 82 as well as closely spaced walls can also be used. Preferably, as shown in FIG. 4, the closure elements are pinched together all at once, i.e., the uppermost closure elements 16*a* and 17*a* are pressed together at approximately the same time that the bottommost closure elements 16*b* and 17*b* are pressed together.

As shown in FIG. 4, a separating leg 23 depends from the top 20 between the side walls 21 and 22 and penetrates at least one uppermost closure element 16*a* or 17*a*. As shown, the separating leg is positioned at the separating end 10*a* of the slider 10, although the separating leg can be positioned anywhere along the top.

The separating leg 23 does not extend all the way through the closure elements. Rather, the separating leg 23 extends past at least one of the uppermost closure elements 16*a* or 17*a* but does not extend far enough to reach between the bottommost closure elements 16*b* and 17*b*.

When the slider 10 is moved toward the open position 36, the pinching end 10*b* of the slider leads, and the separating end 10*a* of the slider trails, so that the separating leg 23 disengages the closure elements. When the slider 10 is moved toward the closed position 35, the separating end 10*a* leads and the pinching end 10*b* trails, so that pinching means near the pinching end 10*b* squeezes the closure elements together into engagement. The spacing between the bottommost closure elements 16*b* and 17*b* and the uppermost closure elements 16*a* and 17*a*, should be sufficient so that the bottommost closure elements 16*b* and 17*b* are pulled open as the separating leg 23 forces the uppermost closure elements apart when the slider moves toward the open position 36.

The fastening assembly optionally includes means for maintaining the slider in straddling relation with the fastener strips 14 and 15. In the embodiment shown in FIGS. 2–7, the means includes ridges 25 on the outer surfaces of the fastening strips 14 and 15, and shoulders 21*a*, 22*a*, 21*b* and 22*b* on the side walls of the slider. Shoulders 21*a* and 22*a* project inwardly from the depending side walls at the separating end 10*a* of the slider. As shown, the slider also has shoulders 21*b* and 22*b* projecting inwardly from the depending side walls at the pinching end 10*b* of the slider. The shoulders 21*a*, 22*a*, 21*b* and 22*b* project inwardly at a point at or below the profiles 16 and 17. The shoulders act as means for maintaining the slider in straddling relation with the fastening strips by grasping the lower surfaces of the ridges 25. The ridges 25 thus act as handles for the slider to hold onto, such that the slider 10 maintains the straddling relation with the fastening strips and does not fall off the bag. The shoulders can be continuous along the entire length of the slider, if desired, in order to maximize the security to the bag. Ridges 25 extend along the length of the outer surface of fastener strips 14 and 15 at a point below the uppermost closure elements 16*a* and 17*a*, and can be attached to the fastener strips by any desired means, such as, for example, by extruding with the fastener strips, heating, gluing, or snapping in place. The ridges can also result from the difference in thicknesses between the fastener and the bag.

Figure 5:
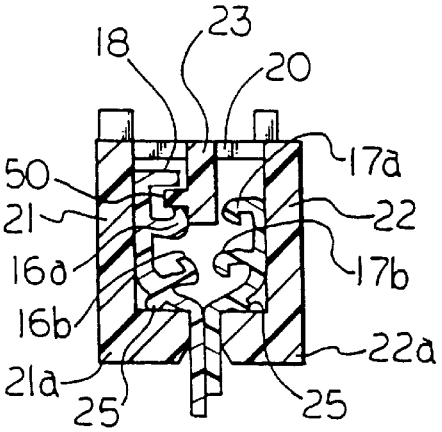
FIG. 5 is a cross sectional view of an alternate embodiment of an open fastener assembly.

Alternatively, means for maintaining the slider in straddling relation with the fastening strips can include an extension 50 on the separating leg 23 in conjunction with a flange 18 positioned above uppermost closure element 16*a* along the length of fastener strip 14, as shown in FIG. 5. As the slider moves along the fastener strips, the extension 50 slides between the uppermost closure element 16*a* and the flange 18. When the fastening assembly is closed, flange 18 covers the uppermost closure elements 16*a* and 17*a*. Preferably, flange 18 is positioned along a fastener strip even if the slider does not include extension 50. There may be a flange on both fastening strips, if desired.

The slider 10 may be made in multiple parts and welded together or the parts may be constructed to be snapped together. The slider 10 may also be of one piece construction. The slider can be made using any desired method, such as, for example, injection molding or any other method. The slider can be molded from any suitable plastic such, for example, as nylon, polypropylene, polystyrene, acetal, toughened acetal, polyketone, polybutylene terephthalate, high density polyethylene, polycarbonate, or ABS. The slider can be clear, opaque, or colored.

Referring again to FIG. 1, a bag incorporating the fastener and slider of the present invention optionally includes means for preventing the slider from sliding off the end of the bag once the slider reaches the closed position 35 or open position 36. Preferably, the means for preventing the slider from sliding off the end includes means for holding the bottommost closure elements in interlocked relationship when the slider is in the closed position, including the area beneath the separating leg, such that the bottommost closure elements are in interlocked relationship throughout substantially their entire length. Such means for holding the bottommost closure elements together can include, for example, a fused section of the bottommost closure elements proximate to the closed position 35. The fused section of the closure elements proximate to the closed position preferably creates a raised end stop 30. The term "raised end stop" is defined herein to mean that the end stop rises vertically from the fastener strip in the same plane as the bag, as opposed to extending transversely out of the plane of the bag. Preferably, a raised end stop is also proximate to the open position 36.

"Proximate to the closed position" is defined herein to mean the space at least between the slider and the ends of the fastener strips when the slider is in the closed position. This distance can be narrow, if the closed position is chosen to be towards the very end of the fastener strip, or this distance can be wide, if the closed position is chosen to be farther away from the ends of the fastener strips, such as when large end stops are desired.

When an end stop 30 is used in conjunction with a ridge 25, it is preferred that the ridge 25 extends into the end stop to a point beyond the separating end 10*a* of the slider when the slider is in the closed position 36. In other words, the ridge 25 preferably extends on each end of the fastener strip at least to an inward edge 31 of the fused section of end stop 30, and preferably past the inward edge thereof, as shown in FIG. 1, so that the ridge 25 works to cooperate with the end stop 30 to hold the slider 10 onto the bag.

The closure elements can be fused by a clamp, an adhesive, pressure, heat, mechanically, ultrasonically, or by any other desired method. The resulting raised end stops 30 perform the dual function of stops for the ends of the fastener 11 to prevent the slider 10 from going off past the end of the fastener 11 and they also hold the two profiles 16 and 17 together to prevent the bag from opening in response to stresses applied to the fastener strips through normal use of the bag. The end stops 30 also provide a convenient finger grip for the user when moving the slider 10.

Alternative means for preventing the slider from sliding off the end of the bag include riveted end clamps such as those described in U.S. Pat. Nos. 5,067,208 and 5,161,286, transverse end stops made from molten material of the fastener strips, as described in U.S. Pat. No. 5,088,971, reciprocating anvils, as described in U.S. Pat. No. 5,131,121, tubular end stops, as described in U.S. Pat. No. 5,405,478, a window structure combined with sealed zipper ends, as described in U.S. Pat. No. 5,442,837, or plastic end clips fused to the zipper as described in U.S. Pat. No. 5,448,807.

The fastening assembly of the present invention optionally includes means for retaining the slider in the closed position so that a bag incorporating the zipper and slider of the present invention does not inadvertently open. For example, the means for retaining the slider in closed position can comprise a notch structure such as that disclosed in U.S. Pat. No. 5,067,208, or a notch structure with diverging ends such as that disclosed in U.S. Pat. No. 5,301,395. In yet another alternative, the means for retaining the slider in closed position can comprise latching means, such as a detent on the slider together with a protrusion on the zipper as disclosed in U.S. Pat. No. 5,189,764.

The fastener strips of the present invention can be made using methods well known in the art, such as, for example, by blow or cast extrusion. The slider can be attached to the fastener strips using methods such as causing reciprocal movements of the clasp using a tool, as described in U.S. Pat. No. 4,262,395, through a hinge structure which attaches wings to the body of the slider, as described in U.S. Pat. No. 5,067,208, through a rigidizing structure as described in U.S. Pat. No. 5,283,932, or through in-place assembly.

What is claimed is:

1. A reclosable fastener assembly comprising:

a) a first fastener strip having an inner surface and an outer surface, the first fastener strip having at least an uppermost closure element and a bottommost closure element positioned along the length of the inner surface;

b) a second fastener strip having an inner surface and an outer surface, the second fastener strip having at least an uppermost closure element and a bottommost closure element positioned along the length of the inner surface, the closure elements along the second fastener strip being adapted to engage with the closure elements along the first fastener strip, thereby interlocking the second fastener strip with the first fastener strip; and c) a slider for moving between a closed position and an open position along the fastening strips in straddling relation, the slider having a top and side walls depending from opposite sides of the top for receiving the fastener strips therebetween, the side walls extending downward from the top to a point below the uppermost closure elements, so that at least a portion of the fastener strips are held between the side walls, the side walls extending from a separating end of the slider to a pinching end, the slider including pinching means proximate to the pinching end, the pinching means being adapted to press the first and second fastener strips into an interlocked relationship as the slider is moved toward the closed position, the slider having a separating leg depending from the top between the first and second side walls at the separating end of the slider, the separating leg penetrating at least one of the uppermost closure elements of the first or second fastener strips, but not the bottommost closure elements.

2. The fastener assembly of claim 1 wherein the fastener strips are fused proximate to the closed position.

3. The fastener assembly of claim 2 wherein the fused fastener strips create an end stop.

4. The fastener assembly of claim 2, wherein the fused fastener strips create an end stop and hold the bottommost closure elements together such that when the slider is in the closed position, the bottommost closure elements are in interlocked relationship throughout their entire length.

5. The fastener assembly of claim 4, further comprising means for maintaining the slider in straddling relation with the fastening strips.

6. The fastener assembly of claim 5, wherein the means for maintaining the slider in straddling relation includes shoulders depending from the side walls of the slider, and at least one ridge projecting from the outside edges of the fastener strips along the lengths thereof, such that the shoulders grasp the surface of at least one ridge.

7. The fastener assembly of claim 6, wherein the end stop rises vertically from the fastener strips and the ridge extends into the end stop to a point beyond the separating end of the slider when the slider is in the closed position.

8. The fastener assembly of claim 7, wherein the first fastener strip includes a flange positioned above the uppermost closure element along the length thereof.

9. The fastener assembly of claim 8, wherein the profiles are fused by means of a clamp, an adhesive, melting means, ultrasonic means, or mechanical means.

10. The fastener assembly of claim 9, wherein the pinching means includes ribs on the inside of the sidewalls proximate to the pinching end of the slider, walls angled so as to have a smaller spacing at the pinching end that at the separating end, or a combination thereof.

11. A thermoplastic bag having the fastener assembly of claim 10 positioned across the top thereof.

12. The fastener assembly of claim 5, wherein the means for maintaining the slider in straddling relation includes a flange positioned above the uppermost closure element along the length of at least one of the fastener strips, and an extension protruding from the separating leg, the extension sliding between the uppermost closure element and the flange as the slider moves.

* * * * *